US008808151B1

(12) United States Patent
Whaley

(10) Patent No.: US 8,808,151 B1
(45) Date of Patent: Aug. 19, 2014

(54) EXERCISE EQUIPMENT AND ADJUSTABLE BAND PEG ASSEMBLIES FOR EXERCISE EQUIPMENT

(75) Inventor: Dennis Whaley, Otsego, MN (US)

(73) Assignee: Brunswick Corporation, Lake Forest, IL (US)

( * ) Notice: Subject to any disclaimer, the term of this patent is extended or adjusted under 35 U.S.C. 154(b) by 238 days.

(21) Appl. No.: 13/451,304

(22) Filed: Apr. 19, 2012

Related U.S. Application Data

(60) Provisional application No. 61/583,070, filed on Jan. 4, 2012.

(51) Int. Cl.
*A63B 21/04* (2006.01)

(52) U.S. Cl.
USPC ..... 482/129

(58) Field of Classification Search
CPC ..... A63B 21/00; A63B 21/00007; A63B 21/0004; A63B 21/00043; A63B 21/02; A63B 17/00; A63B 21/0724; A63B 21/0726
USPC ..... 482/92, 104, 20, 98, 129–130, 121–126
See application file for complete search history.

(56) References Cited

U.S. PATENT DOCUMENTS

| | | | | |
|---|---|---|---|---|
| 4,527,797 | A * | 7/1985 | Slade et al. | 482/101 |
| 6,612,170 | B2 * | 9/2003 | Brown | 73/379.06 |
| 7,753,830 | B1 | 7/2010 | Marsh et al. | |
| 7,927,263 | B1 | 4/2011 | Marsh et al. | |
| 2002/0039953 | A1 * | 4/2002 | Spiel | 482/92 |
| 2005/0032612 | A1 * | 2/2005 | Keiser | 482/93 |
| 2008/0058173 | A1 * | 3/2008 | Mattox | 482/92 |
| 2009/0054215 | A1 * | 2/2009 | McBride et al. | 482/129 |
| 2010/0216613 | A1 * | 8/2010 | Pacini | 482/122 |

* cited by examiner

*Primary Examiner* — Oren Ginsberg
*Assistant Examiner* — Megan Anderson
(74) *Attorney, Agent, or Firm* — Andrus Intellectual Property Law, LLP

(57) ABSTRACT

Exercise equipment and adjustable band peg assemblies for exercise equipment have a base frame with a plurality of band peg holes therein. A band peg is movably connected to the base frame so as to be selectively inserted in different holes in the plurality of band peg holes while remaining connected to the base frame.

16 Claims, 6 Drawing Sheets

EXERCISE EQUIPMENT AND ADJUSTABLE BAND PEG ASSEMBLIES FOR EXERCISE EQUIPMENT

CROSS-REFERENCE TO RELATED APPLICATION

The present application is based on and claims priority to U.S. Provisional Patent Application Ser. No. 61/583,070 filed Jan. 4, 2012, which is incorporated herein by reference in entirety.

FIELD

The present disclosure relates to exercise equipment, including weight training equipment, including weight racks and benches.

BACKGROUND

U.S. Pat. Nos. 7,753,830 and 7,927,263, the disclosures of which are hereby incorporated herein by reference in entirety, disclose exercise equipment including a weight rack frame and bench frame releasably lockable to the weight rack frame at a plurality of selectable locking locations therealong.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some examples, an adjustable band peg assembly for exercise equipment is provided. The assembly has a base frame with a plurality of band peg holes therein. A band peg is movably connected to the base frame so as to be selectively inserted in different holes in the plurality of band peg holes while remaining connected to the base frame.

In other examples, exercise equipment has a laterally extending base frame having a plurality of band peg holes therein. A band peg is laterally movably connected to the base frame so as to be selectively inserted in different holes of the plurality of band peg holes while remaining connected to the base frame. A weight bar is provided and a laterally extending support bar is spaced vertically above the base frame and vertically below the weight bar. The support bar supports the weight bar. An elastic band extends between the weight bar and the movable band peg so as to bias the weight bar towards the support bar at least when the weight bar is moved vertically with respect to the support bar.

BRIEF DESCRIPTION OF THE DRAWINGS

Examples of adjustable band peg assemblies are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

Figure 1:
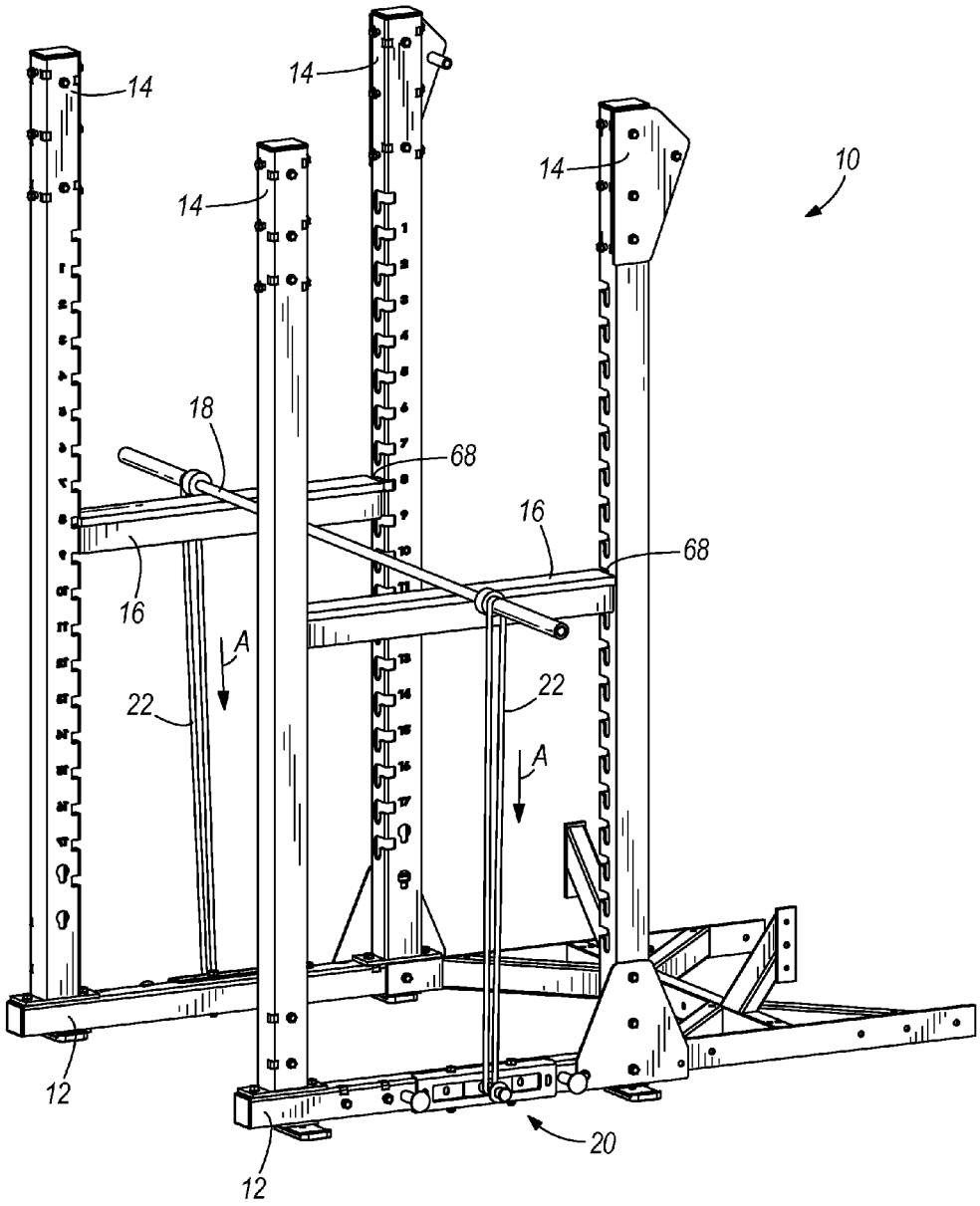
FIG. 1 is a perspective view of exercise equipment having an adjustable band peg assembly.

FIG. 1 depicts exercise equipment 10, which in the examples shown is weight training equipment. The exercise equipment 10 has a laterally extending base frame 12, four generally vertically extending frame members 14, and two laterally extending support bars 16 spaced vertically above the base frame 12. A weight bar 18 is resting on and supported by the support bars 16. A band peg assembly 20 is provided on the base frame 12. The band peg assembly is further described herein below with reference to FIGS. 2-8. A pair of elastic bands 22, which in the examples shown are rubber bands, extend between opposing ends of the weight bar 18 and the respective band peg assemblies 20 so as to bias the weight bar 18 towards the support bars 16 in the direction of Arrow A at least when the weight bar 18 is moved vertically with respect to the support bar 16.

Figure 2:
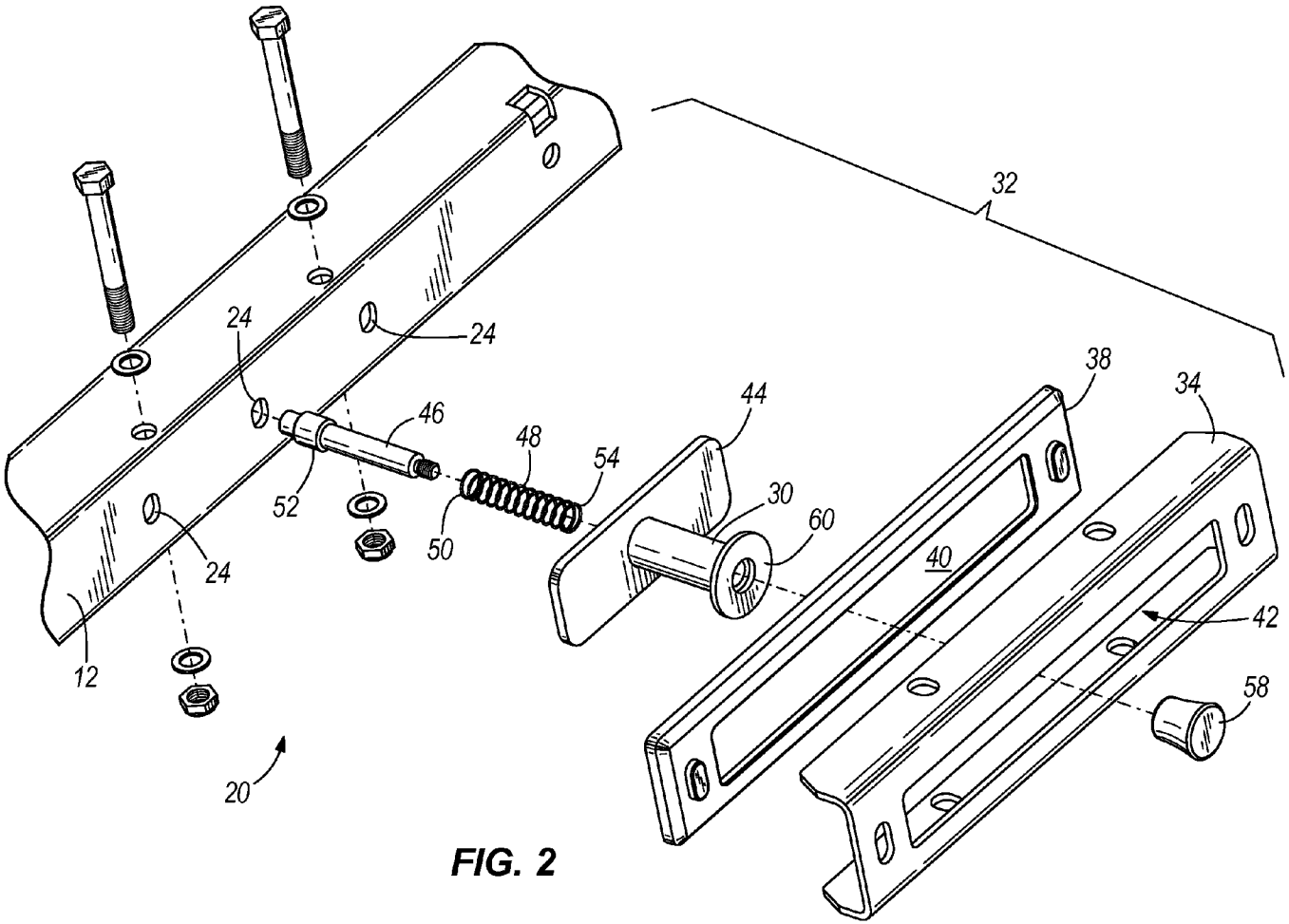
FIG. 2 is an exploded view of the band peg assembly of FIG. 1.
Figure 3:
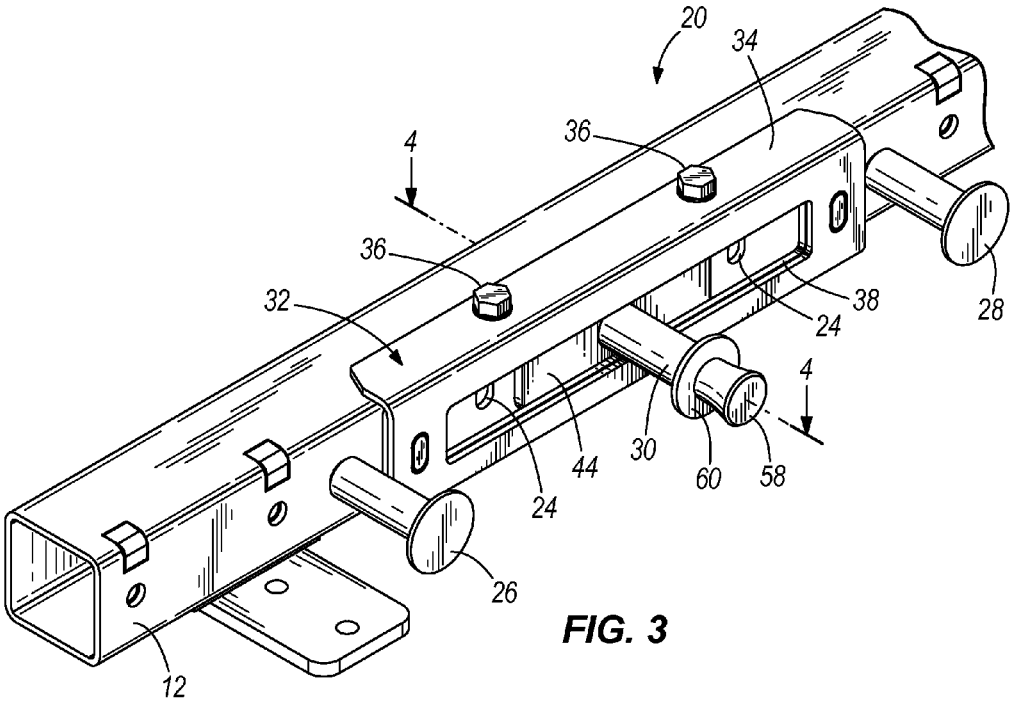
FIG. 3 is a perspective view of the band peg assembly.
Figure 4:
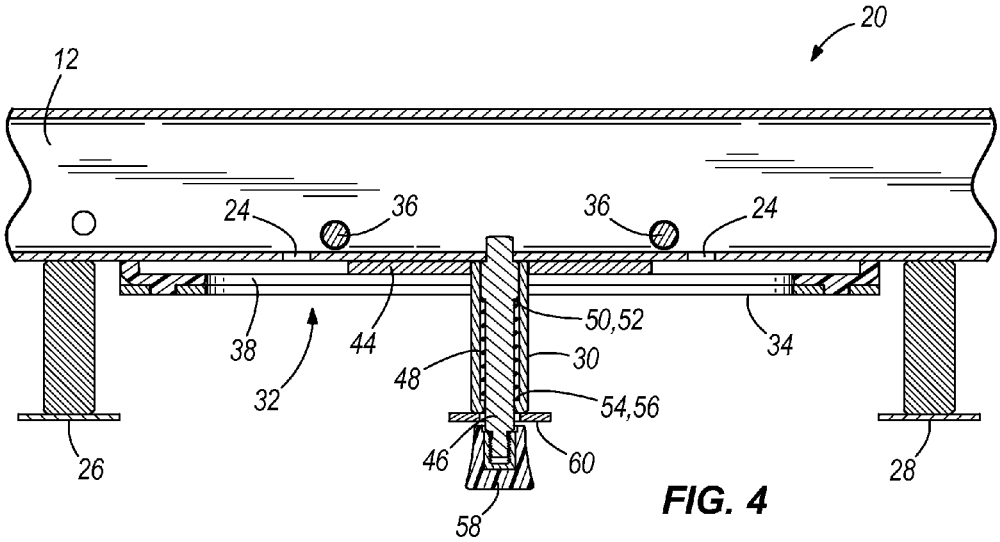
FIG. 4 is a view of section 4-4 taken in FIG. 3.

Referring to FIGS. 2-4, each band peg assembly 20 is attached to the noted base frame 12, which has a plurality of band peg holes 24 therein. A pair of opposing band pegs 26, 28 are fixed with respect to the frame 12. As explained herein below, at least one more band peg 30 is movably connected to the base frame 12 so as to be selectively inserted in respective holes 24 of the plurality of band peg holes 24.

The band peg assembly 20 includes a joint assembly 32 that is fixedly connected to the base frame 12 and supports sliding of the movable band peg 30 with respect to the base frame 12 so as to align the movable band peg 30 with selected band peg holes 24 in the base frame 12. The joint assembly 32 includes a bracket 34 that is fixed to the base frame 12 by bolts 36. A guide plate 38, which can for example be made of plastic, is aligned with the bracket 34 so that a window 40 in the guide plate 38 is aligned with a window 42 on the bracket 34. A band peg weldment 44 is welded to the movable band peg 30 and together the band peg weldment 44 and movable band peg 30 are slidable with respect to the guide plate 38 and bracket 34. The band peg weldment 44 is sandwiched between the guide plate 38 and base frame 12, and the movable band peg 30 extends outwardly through the windows 40, 42 in the guide plate 38 and bracket 34, respectively.

A pin 46 extends through the movable band peg 30. A spring 48 is also disposed in the movable band peg 30 and has one end 50 that abuts a flange surface 52 on the pin 46 and another end 54 that abuts against an inside surface 56 of the movable band peg 20. The spring 48 biases the pin 46 towards the base frame 12, inwardly through the band peg weldment 44 and through a selected band peg hole 24 in the base frame 12. A cap 58 abuts an outer surface 60 of the movable band peg 30.

Figure 5:
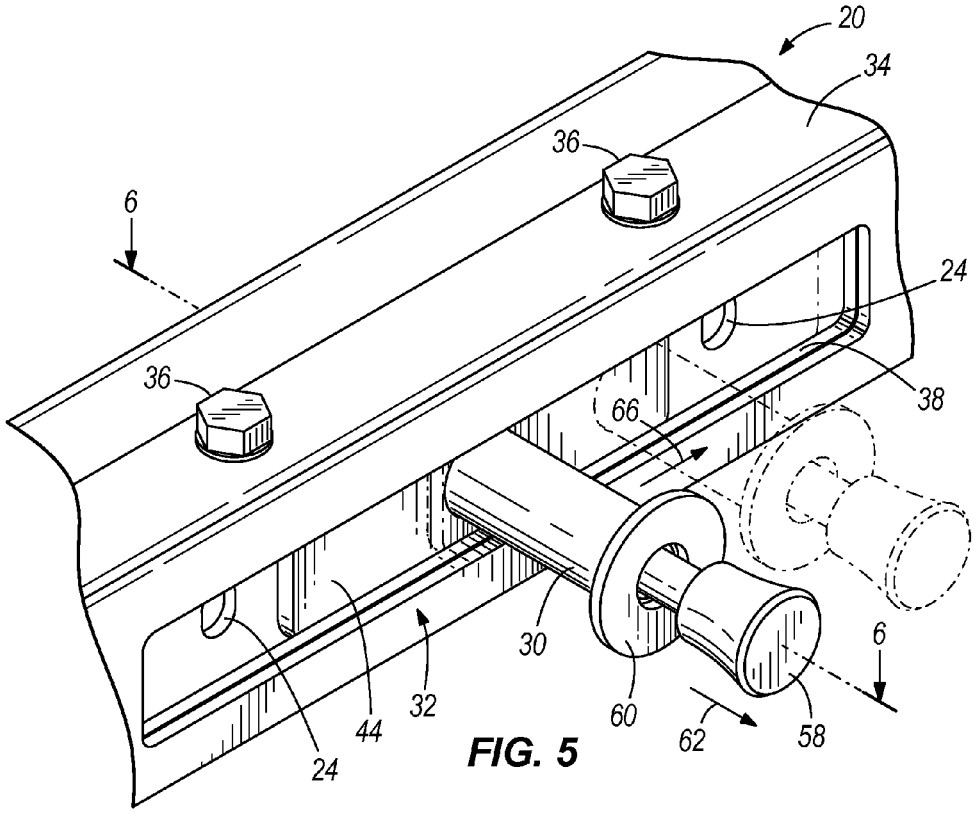
FIG. 5 is a perspective view of a movable band peg.
Figure 6:
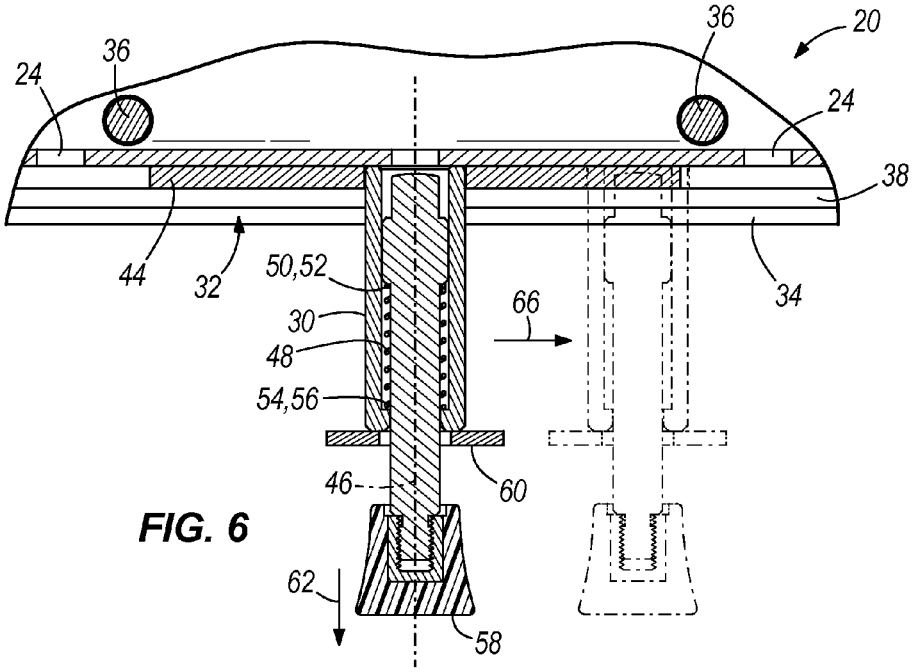
FIG. 6 is a view of section 6-6 taken in FIG. 5.
Figure 7:
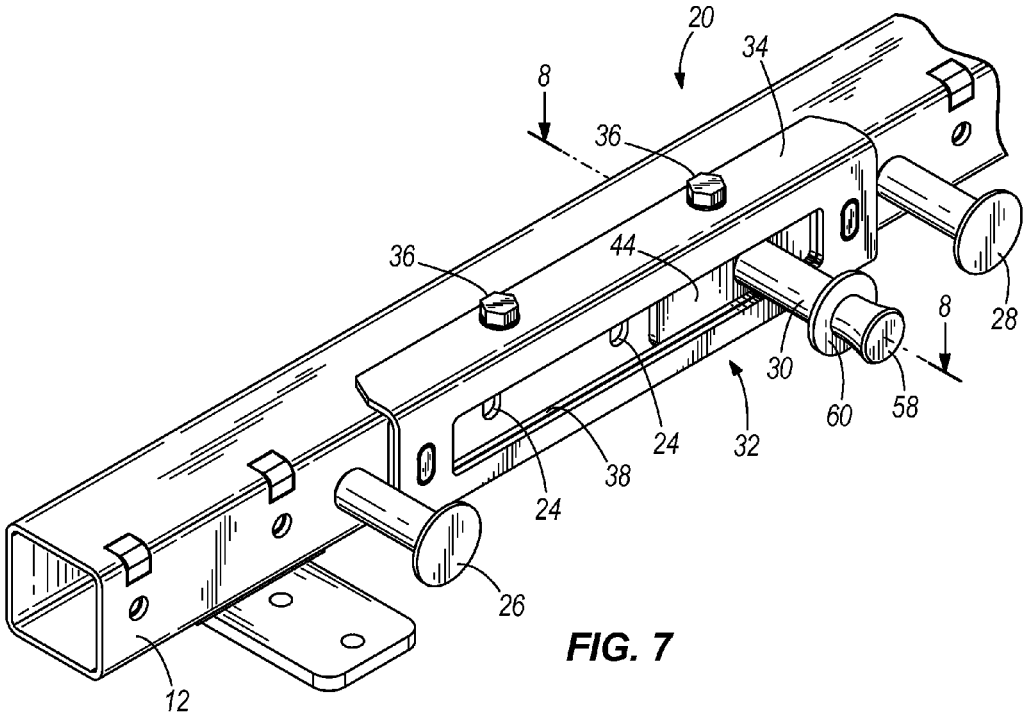
FIG. 7 is another perspective view of the band peg assembly.
Figure 8:
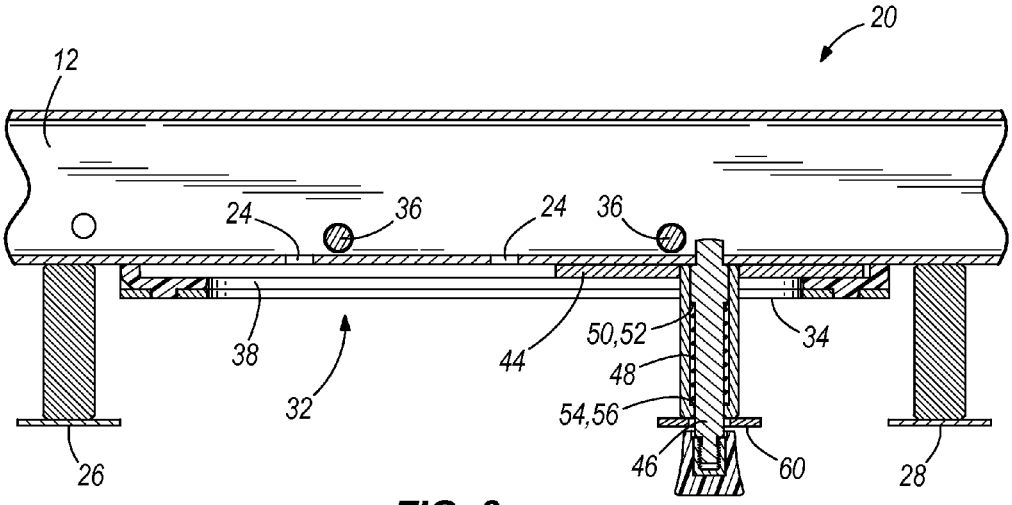
FIG. 8 is a view of section 8-8 taken in FIG. 7.

FIGS. 5-8 depict operation of the band peg assembly 20. Referring to FIGS. 5 and 6, the cap 58 is manually grasped by the user and pulled outwardly away from the base frame 12 in the direction of arrow 62 to extract the pin 46 outwardly from the respective band peg hole 24, against the bias of spring 48. This allows for sliding movement of the band peg weldment 44 and movable band peg 30 in the direction of arrow 66 for positioning of the movable band peg 30 over a different band peg hole 24 in the base frame 12. Releasing the cap 58 allows the spring 48 to bias the pin 46 back towards the base frame 12 and into the respective band peg hole 24, until the cap 58 abuts the surface 60 of the movable band peg 30. This locks the band peg 30 with respect to the base frame 12, as shown in FIGS. 7 and 8.

The present disclosure thus provides a band peg assembly 20 wherein the components do not have to be removed from the base frame 12 for a new band peg position. A user can use just one hand to disengage the movable band peg 30 and slide the movable band peg 30 to a new position along the base frame 12. This solves a problem of the prior art, requiring a two-hand operation to remove individual pieces of band pegs. Since the entire assembly 20 can be secured to a single piece of exercise equipment 10, it is unlikely that any pieces of the assembly 20 will become lost or misplaced.

Figure 9:
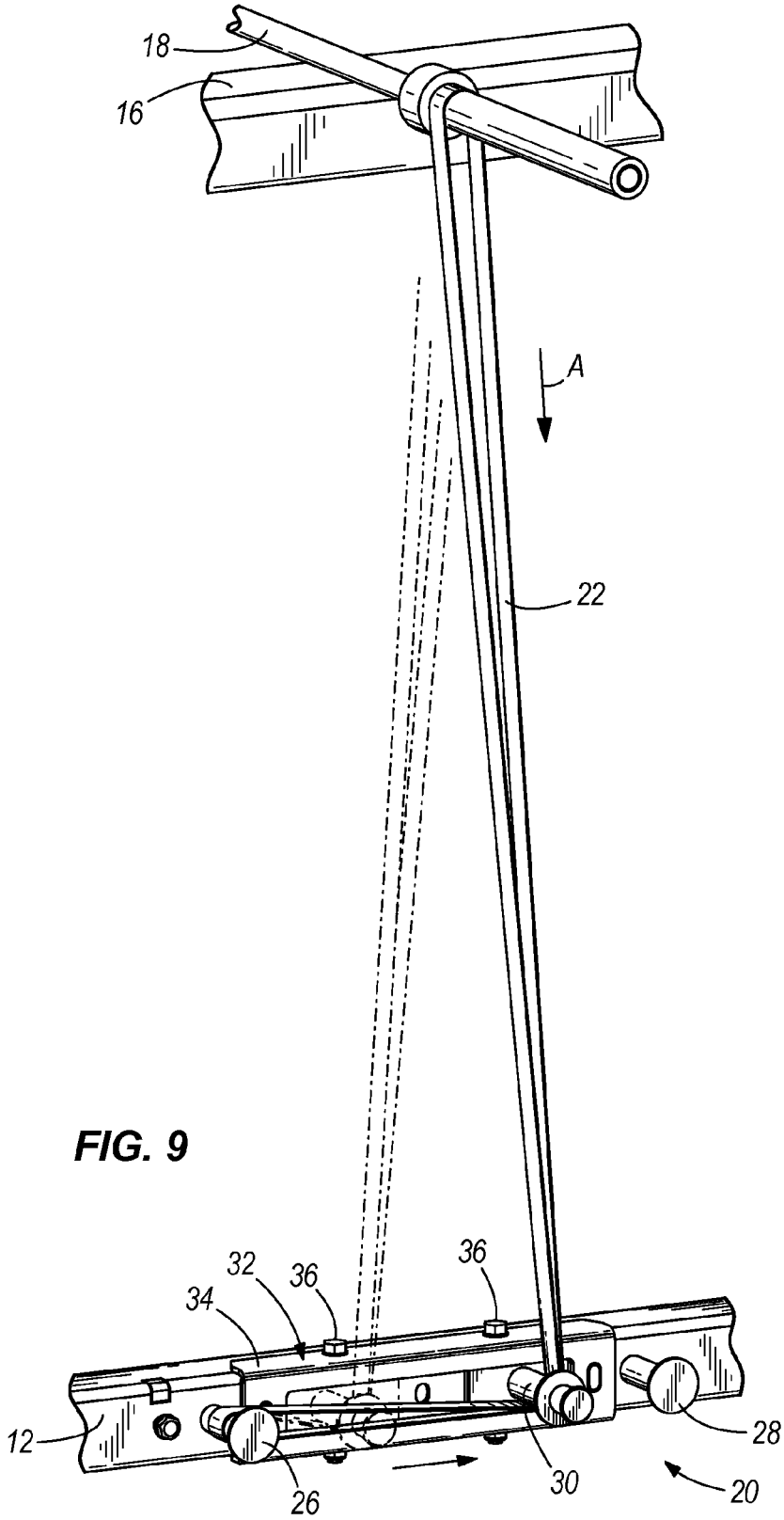
FIG. 9 is a perspective view of the band peg assembly, a weight bar, and an elastic band.

Referring to FIG. 9, the exercise equipment 10 having the band peg assembly 20 provides several functional advantages to the user. In use, the elastic band 22 can extend from the end of the weight bar 18 and around at least one of the fixably connected band pegs 26, 28 and also the movable band peg 30. In this manner, laterally moving the movable band peg 30 with respect to the base frame 12 adjustably changes the bias of the elastic band 22 with respect to the weight bar 18, thus adjusting the amount of effort necessary to lift the weight bar 18 with respect to the support bars 16. In an alternate embodiment, the elastic band 22 can extend between the weight bar 18 and across both the fixed band pegs 26, 28 and the movable band peg 30. The elastic band 22 can be wrapped around and connected to all or some of the band pegs 26, 28, 30, thus allowing for numerous different amounts of bias, and thus different resistance to lifting of the weight bar 18.

Further, referring to FIG. 1, the laterally extending support bars 16 are movably coupled to the vertically extending frame members 14 along a plurality of vertical positions to thereby change the distance between the support bars 16 and base frame 12, and thereby change the bias of the elastic band 22. In this example, the support bars 16 are movably coupled to the vertically extending frame members 14 by tab and slot connections 68. Other types of movable connections could be employed.

Thus, the combination of the vertically movable laterally extending support bars and laterally movable band peg 30 allows for a wide range of resistance characteristics to the user.

Although only a few examples have been described in detail above, those skilled in the art will readily appreciate that many modifications are possible in the examples without materially departing from this invention. Accordingly, all such modifications are intended to be included within the scope of this disclosure as defined in the following claims. In the claims, means plus function clauses are intended to cover the structures described herein as performing the recited function and not only structural equivalents, but also equivalent structures. Thus, although a nail and a screw may not be structural equivalents in that a nail employs a cylindrical surface to secure wooden parts together, and whereas a screw employs a helical surface, in the environment of fastening wooden parts, a nail and a screw may be equivalent structures. It is the express intention of the Applicant not to invoke 35 U.S.C. §112, paragraph 6, for any limitations of any of the claims herein, except for those in which the claim expressly uses the words "means for" together with an associated function.

What is claimed is:

1. An adjustable band peg assembly for exercise equipment, the assembly comprising:

a base frame having a plurality of band peg holes therein;

a band peg that is movably connected to the base frame so as to be selectively inserted in different holes of the plurality of band peg holes while remaining connected to the base frame;

wherein the band peg comprises a pin that is biased towards the base frame; and a joint assembly connected to the base frame and supporting the band peg;

wherein the joint assembly comprises a bracket that is fixed to the base frame; and wherein the joint assembly further comprises a guide plate disposed between the bracket and the base frame.

2. An assembly according to claim 1, wherein the joint assembly further comprises a weldment that is disposed between and is slideable with respect to the guide plate and the base frame.

3. An assembly according to claim 2, wherein the bracket and guide plate define windows through which the hand peg extends.

4. An assembly according to claim 3, wherein the pin is biased inwardly through the band peg, through the windows of the bracket and the guide plate, and through one of the plurality of band peg holes in the base frame.

5. An assembly according to claim 4, further comprising a cap that prevents the pin from passing through the baud peg.

6. An assembly according to claim 1, comprising at least one band peg that is fixedly connected to the base frame.

7. Exercise equipment comprising:

a laterally extending base frame having a plurality of band peg holes therein;

a band peg that is laterally movably connected to the base frame so as to be selectively insertable in different holes of the plurality of band peg holes while remaining connected to the base frame;

a weight bar;

a laterally extending support bar spaced vertically above the base frame and vertically below the weight bar, the support bar supporting the weight bar; and an elastic band extending between the weight bar and the movable band peg so as to bias the weight bar towards the support bar at least when the weight bar is moved, vertically with respect to the support bar.

8. Exercise equipment according to claim 7, further comprising at least one band peg fixedly connected to the frame and laterally spaced from the movable band peg, wherein the elastic band extends from the weight bar and around at least one of the fixedly connected band pegs and the movable band peg; wherein laterally moving the movable band peg with respect to the base frame changes the bias of the elastic band with respect to the weight bar.

9. Exercise equipment according to claim 8, wherein the at least one band peg fixedly connected to the frame comprises one of at least two band pegs fixedly connected to the frame and laterally spaced from the movable band peg, including a first band peg disposed on one side of the movable band peg and a second band peg disposed on a second, opposite side of the movable band peg; wherein the elastic band extends between the weight bar and across the first and second band pegs and the movable band peg.

10. Exercise equipment according to claim 7, wherein the base frame comprises at least one generally vertically extending frame member and wherein the support bar is coupled to the vertically extending frame member.

11. Exercise equipment according to claim 10, wherein the support bar is movably coupled to the vertically extending frame member along a plurality of vertical positions to thereby change the distance between the support bar and the base frame and thereby change the bias of the elastic band.

12. Exercise equipment according to claim 11, wherein the support bar is movably coupled to the vertically extending frame member by a tab and slot connection.

13. An assembly according to claim 7, wherein the band peg comprises a pin that is biased towards the base frame and comprising a joint assembly connected to the base frame and supporting the band peg, wherein the joint assembly comprises a bracket that is fixed to the base frame.

14. An assembly according to claim 13, wherein the joint assembly comprises a guide plate disposed between the bracket and the base frame and further comprises a weldment that is disposed between and slideable with respect to the guide plate and the base frame.

15. An assembly according to claim 14, wherein the bracket and guide plate define windows through which the band peg extends and comprising a pin that is biased inwardly through the band peg and through a band peg hole in the base frame.

16. An assembly according to claim 15, further comprising a cap that prevents the pin from passing through the band peg.

* * * * *

UNITED STATES PATENT AND TRADEMARK OFFICE

CERTIFICATE OF CORRECTION

PATENT NO. : 8,808,151 B1
APPLICATION NO. : 13/451304
DATED : August 19, 2014
INVENTOR(S) : Dennis Whaley It is certified that error appears in the above-identified patent and that said Letters Patent is hereby corrected as shown below:

In the Claims:

Column 4, Lines 25-28, Claim 3 should read
3. An assembly according to claim 2, wherein the bracket and guide plate define windows through which the ~~hand~~ band peg extends.

Column 4, Lines 32-33, Claim 5 should read
5. An assembly according to claim 4, further comprising a cap that prevents the pin from passing through the ~~baud~~ band peg.

Column 5, Lines 13-17, Claim 13 should read
13. ~~An assembly~~ Exercise equipment according to claim 7, wherein the band peg comprises a pin that is biased towards the base frame and comprising a joint assembly connected to the base frame and supporting the band peg, wherein the joint assembly comprises a bracket that is fixed to the base frame.

Column 5, Lines 18-22, Claim 14 should read
14. ~~An assembly~~ Exercise equipment according to claim 13, wherein the joint assembly comprises a guide plate disposed between the bracket and the base frame and further comprises a weldment that is disposed between and slideable with respect to the guide plate and the base frame.

Column 5, Lines 23-27, Claim 15 should read
15. ~~An assembly~~ Exercise equipment according to claim 14, wherein the bracket and guide plate define windows through which the band peg extends and comprising a pin that is biased inwardly through the band peg and through a band peg hole in the base frame.

Column 5, Lines 28-30, Claim 16 should read
16. ~~An assembly~~ Exercise equipment according to claim 15, further comprising a cap that prevents the pin from passing through the band peg.

Signed and Sealed this
Twenty-first Day of October, 2014

Michelle K. Lee

Michelle K. Lee
*Deputy Director of the United States Patent and Trademark Office*